US007918233B2

(12) United States Patent
Burgess et al.

(10) Patent No.: US 7,918,233 B2
(45) Date of Patent: Apr. 5, 2011

(54) FINGER CLEANING MULTI-TOOL

(75) Inventors: Patrick Burgess, Marina Vallaita (MX); Tylor Garland, Studio City, CA (US); Aldis Rauda, West Hollywod, CA (US); Stan Chudzik, Alpharetta, GA (US); Christin Hartsfield, Atlanta, GA (US)

(73) Assignee: Goody Products, Inc., Atlanta, GA (US)

( * ) Notice: Subject to any disclaimer, the term of this patent is extended or adjusted under 35 U.S.C. 154(b) by 447 days.

(21) Appl. No.: 11/953,369

(22) Filed: Dec. 10, 2007

(65) Prior Publication Data

US 2009/0145451 A1 Jun. 11, 2009

(51) Int. Cl.
*A45D 29/04* (2006.01)

(52) U.S. Cl. ..... 132/75.6

(58) Field of Classification Search ..... 132/73–285; 15/167, 167.3, 167.2, 187; 401/11
See application file for complete search history.

(56) References Cited

U.S. PATENT DOCUMENTS

| | | | | | |
|---|---|---|---|---|---|
| 587,243 | A | | 7/1897 | Sloan | |
| 1,750,451 | A | * | 3/1930 | Wrightson et al. | 132/75.6 |
| 1,900,028 | A | * | 3/1933 | Snider | 132/75.6 |
| 2,279,533 | A | * | 4/1942 | Shore | 132/75.6 |
| 2,447,451 | A | * | 8/1948 | Windmoeller | 132/76.2 |
| 2,695,416 | A | | 11/1954 | Raimo | |
| 3,354,492 | A | * | 11/1967 | Baumgartner | 15/167.1 |
| 3,387,313 | A | * | 6/1968 | Smith et al. | 15/111 |
| 3,467,978 | A | * | 9/1969 | Golden | 15/111 |
| 3,681,806 | A | | 8/1972 | Han | |
| 3,744,078 | A | | 7/1973 | Vallis | |
| 3,843,991 | A | | 10/1974 | Vallis | |
| 4,050,825 | A | | 9/1977 | Stein | |
| 4,559,957 | A | | 12/1985 | Hokama | |
| 4,757,571 | A | | 7/1988 | Young | |
| 4,866,806 | A | * | 9/1989 | Bedford | 15/104.94 |
| 4,947,876 | A | | 8/1990 | Larsen | |
| 5,143,100 | A | | 9/1992 | Kawakami | |
| 5,377,505 | A | | 1/1995 | McVay, III | |
| 5,442,829 | A | | 8/1995 | Summers | |
| 5,947,131 | A | | 9/1999 | Kim | |
| 5,996,590 | A | | 12/1999 | Steege | |
| 6,086,275 | A | * | 7/2000 | King | 401/11 |
| 6,102,048 | A | | 8/2000 | Baker | |
| 6,145,512 | A | * | 11/2000 | Daley | 132/76.4 |
| 6,289,901 | B1 | | 9/2001 | Singer et al. | |
| 6,314,965 | B1 | * | 11/2001 | Walker | 132/74.5 |
| 6,536,065 | B2 | | 3/2003 | Forrest | |
| D505,267 | S | | 5/2005 | Woods | |
| D506,069 | S | | 6/2005 | Woods | |
| D507,407 | S | | 7/2005 | Woods | |

* cited by examiner

*Primary Examiner* — Robyn Doan
*Assistant Examiner* — Brianne O'Neill
(74) *Attorney, Agent, or Firm* — Lempia Summerfield Katz LLC

(57) ABSTRACT

The present disclosure is generally directed to a tool with multiple functions for use in cleaning fingers and fingernails.

20 Claims, 2 Drawing Sheets

FINGER CLEANING MULTI-TOOL

RELATED APPLICATIONS

This application claims the benefit of U.S. Design Application Ser. No. 29/275,610 under 35 USC §119 or 120, filed Dec. 30, 2006.

FIELD OF THE DISCLOSURE

The present disclosure is generally directed to a tool with multiple functions for use in cleaning fingers and fingernails.

BACKGROUND OF THE DISCLOSURE

Typical means for cleaning fingers and fingernails involve using finger brushes or simply scrubbing the hands with ordinary soap. When fingers or the area underneath fingernails are particularly dirty, such as after painting, staining, or similar projects, ordinary soap or finger brushes may not be adequate for proper cleansing.

SUMMARY OF THE INVENTION

The present invention is directed to a multi-tool with more than one side where the multi-tool is designed to clean fingers through use of a file, wedge tip or one or more sets of bristles. In a related embodiment, the multi-tool may also include a center aperture lined with one or more rows of bristles adapted to scrub a finger. In another embodiment, a second set of bristles may be positioned along an outer edge of the multi-tool.

In a more specific embodiment, a multi-tool may have three sides; an upper and lower surface; and a center aperture. In this embodiment, the first side and second side preferably meet to form a wedge tip, the center aperture is lined with one or more rows of bristles, the first and second side may form a nail file component; and the third side may have bristles protruding from it. In a related embodiment, the center bristles protrude from a center aperture to surround and scrub a finger. In still another embodiment, the upper and lower surface fit together to constrain the one or more rows of bristles and/or a nail file component.

In an embodiment of the present invention, bristles may be formed from a durable and flexible plastic resin. In a related embodiment, the upper and lower surfaces may be made from a polycarbonate resin material. In a similar embodiment, the tip component may also be made from a polycarbonate resin material. In another embodiment, the upper and lower surfaces may be made from a metallic material. In a related embodiment, the tip component may also be made from a metallic material.

Figure 1:
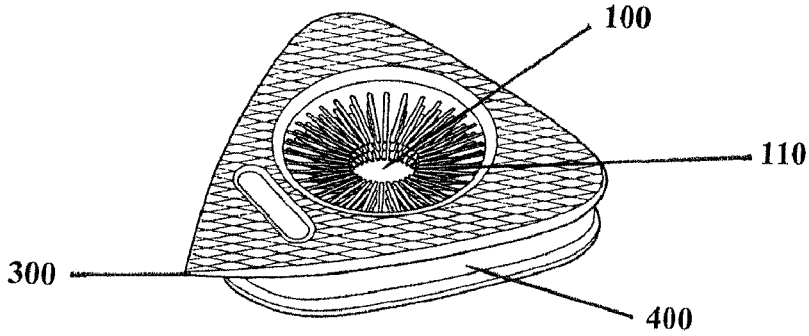
FIG. 1 is a perspective view of one embodiment of the present invention.

Although the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure.

DETAILED DESCRIPTION OF THE DISCLOSURE

The present invention solves the problems described above by combining multiple specific functions into one tool for cleaning fingers. As used herein, the term "finger" includes all types of fingers including the thumb, index, middle, ring and pinkie fingers. The term "finger" also includes the skin, nail, nail bed and cuticle.

Functions of the present invention may include filing, scrubbing, and/or cleaning and may be combined in any number of ways. Referring to FIG. 1, a first function may be accomplished by providing a center aperture 100 rimmed with bristles to form bristle component 110. The bristles preferably extend radially inwardly into the aperture 100 and have innermost ends that define a finger-hole preferably sized to be smaller than an average adult male's smallest finger. This feature may be designed such that a finger may be inserted through the aperture to scrub the circumference of the finger by rotating or twisting the finger within the aperture.

Different bristle materials or shapes may be used in the present invention to create bristles for specific cleaning environments. In one embodiment of the present invention, the bristles are made from a highly durable polypropylene resin. Examples of appropriate resins include, but are not limited to, TPE, TPU, Santoprene, natural latex rubber, polyethylene, polypropylene or nylon. In an alternative embodiment, tufted natural bristles may also be used, such as boar hair. A preferred resin may be a blend of PE and EVA. The shape of the bristle is also important to the present invention because it also helps to control the amount of tension the bristle places upon the finger. In a preferred embodiment, the bristle may be triangular when viewed in a cross-sectional view. Additionally, the bristles should be of a comfortable texture and tension to the user. In one embodiment of the present invention, the bristles are tapered such that the constrained end of the bristle is thicker than the free end of the bristle. In another embodiment of the present invention, the bristle may have a rounded or flat tip.

Figure 8:
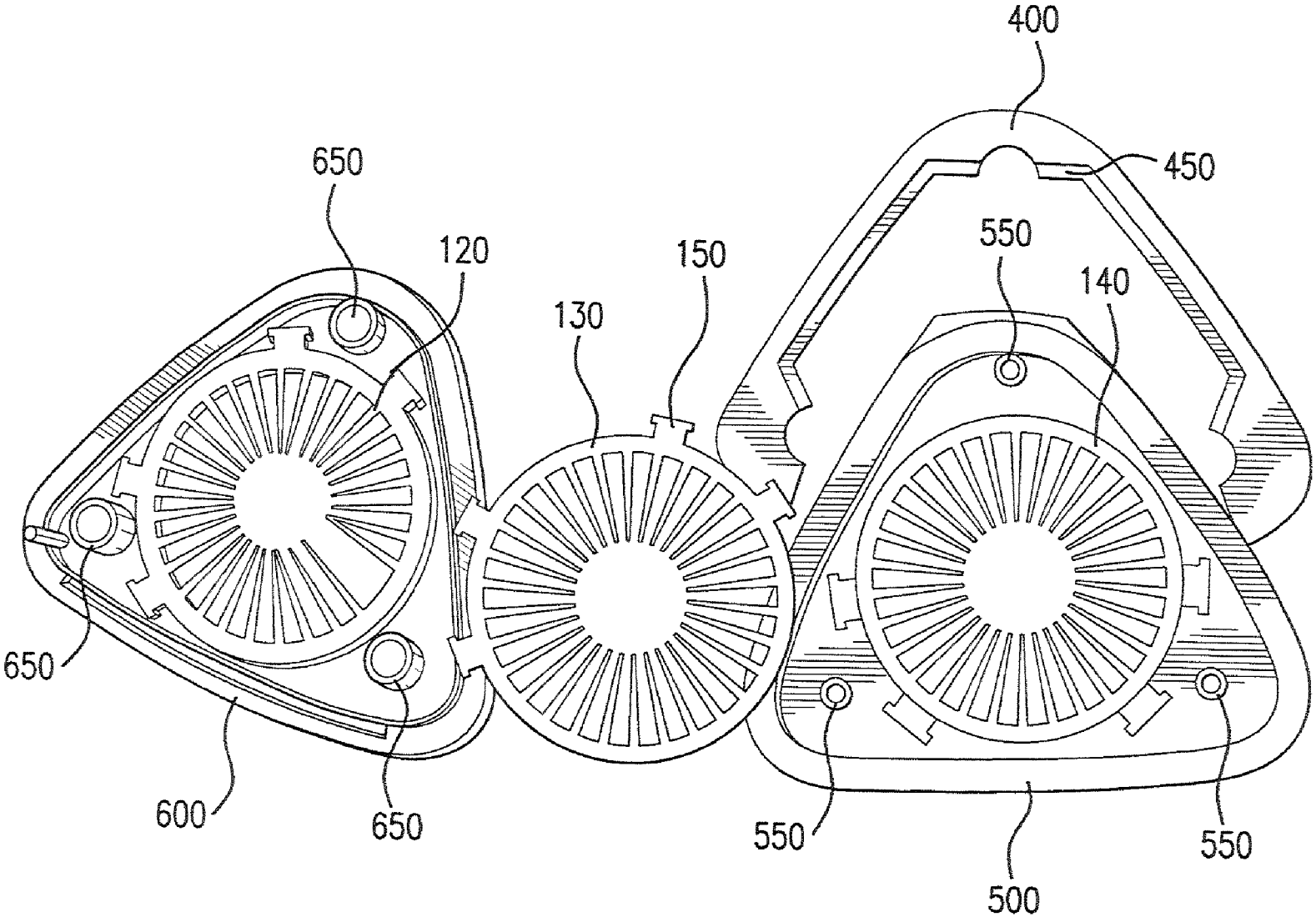
FIG. 8 depicts a bristle assembly according to one embodiment of the present invention.

In a preferred embodiment, shown in FIG. 1, multiple rows of bristles may be aligned parallel to one another or spaced in various patterns such that a maximum scrubbing efficiency may be achieved. In a particular embodiment, the bristles are preferably positioned in an alternating pattern between each bristle row to allow bristles to be placed in the open areas of the adjoining row of bristles. Each bristle may be spaced about 3 mm from center to center. The next row may also have similar placement, but be positioned such that they are placed in the approximate 3 mm gap of the adjoining bristle row such that the spacing between rows of bristles is about 1.5 mm as shown in FIGS. 1 and 8. Referring to FIG. 8, the bristles may be constructed in an assembly such that three separate rings of bristles 120, 130 and 140 are placed on top of each other to provide multiple rows of bristles. In this assembly, the rings of bristles 120 130 and 140 may be notched or tabbed to snap together, forming a single 3-row bristle component 110. The length of the bristles may also be varied to provide a different scrubbing experience.

Figure 2:
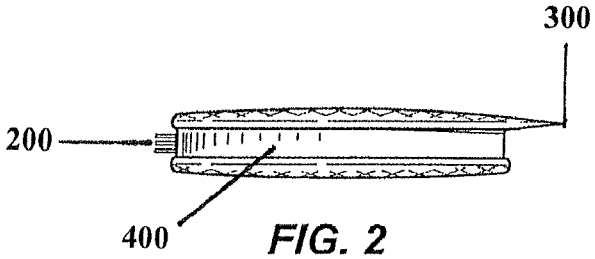
FIG. 2 is a side view of the embodiment shown in FIG. 1.
Figure 3:
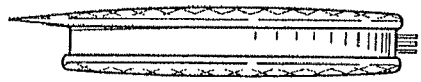
FIG. 3 is another side view of the embodiment shown in FIG. 1.
Figure 4:
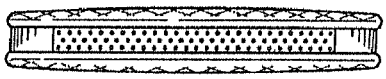
FIG. 4 is another side view of the embodiment shown in FIG. 1.

A second function provided by the present invention may be accomplished by providing shorter scrubbing bristles, as shown in FIG. 2. Such bristles are preferably located along one or more of the outer edges of the multi-tool. Outer bristles 200 may be designed to scrub dirt and grime from underneath the fingernail or for more detailed, local scrubbing of the finger nail or cuticle area. Outer bristles 200 are preferably made from similar materials as bristle component 110. In additional embodiments, the bristles may be made of an alternate material than used in bristle component 110. The bristle density of shorter bristles 200 may also be designed in parallel rows, as shown in FIG. 4 In an alternative embodiment, outer bristles 200 may be arranged in an alternating pattern such that they are positioned approximately 1.5 mm from center to center.

A third function provided by the present invention is a sharp or pointed tip component 300 that may be used to remove dirt from under the fingernail or to push the cuticle back. Tip component 300 may also be used to scrape paint or other similar substances off of the finger, fingernail surface, or around the cuticle area. The tip is preferably located at a junction of two sides of the tool and is made of the same material as the tool for simpler manufacture.

A fourth function provided by the present invention may be a nail file component 400, which is preferably located around part of or the entire perimeter of the tool. The nail file surface is preferably designed to file a finger nail edge to soften or contour the finger nail edge. The material used for nail file component 400 may be of any material with a sufficient grit to file fingernails, such as an etched metal or a plastic resin with embedded grit. A preferable grit surface texture ranges from about 100 sand paper grit to about 200 sand paper grit.

Figure 5:
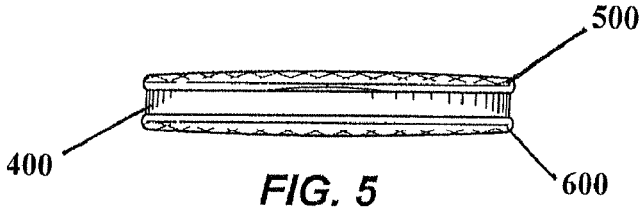
FIG. 5 is another side view of the embodiment shown in FIG. 1.
Figure 6:
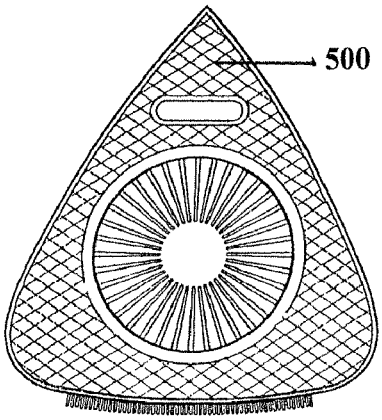
FIG. 6 is a top view of the embodiment shown in FIG. 1.
Figure 7:
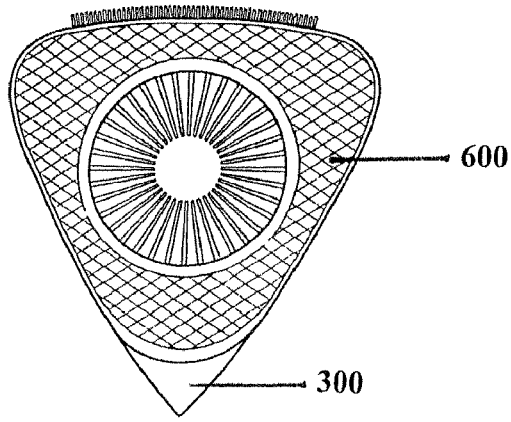
FIG. 7 is a bottom view of the embodiment shown in FIG. 1.

The finger cleaning multi-tool of the present invention may be of any shape and size that is appropriate for the aforementioned uses. The tool may be formed from any material that is durable and capable of being molded. In one embodiment of the present invention, many of the components may be made from metal. Outer nail file components or plates (shown in FIGS. 5, 6, and 7) may be stamped out of metal such as stainless steel, chrome treated carbon steel, or painted carbon steel. Upper plate 500 and lower plate 600 preferably sandwich the nail file component 400, bristle component 110 and outer bristles 200 located along the tool face. In such an embodiment, tip component 300 may be integral to upper plate 500 with a more polished, sharpened finish. The bristle and nail file components may be locked in the appropriate position by spot welding the upper plate 500 and lower plate 600 together to trap the other components. Additionally, a metal wedge locking mechanism or a snap feature stamped within the metal components may be used. Bristle component 110 may be constructed from a TPE or polypropylene material in a circular arrangement adapted to be snapped over a ridge in either side of the metal plates that form the larger surfaces of the tool.

In another embodiment of the present invention, upper plate 500 and lower plate 600 may be made of a polycarbonate resin material. In this embodiment, bristle component 110 and outer bristles 200 may be manufactured in a polyethylene resin. File component 400 may be made with Acrylonitrile Butadiene Styrene (ABS) resin that may be subsequently coated with a translucent sandy grit, preferably suspended in an adhesive resin that allows secure attachment to the ABS substrate. Tip component 300 may also be made of a polycarbonate resin material that may be polished or buffered for a different finish than that of the multi-tool from the flash line to the end of the tip. In another embodiment of the present invention, the surface of the tool may be textured to improve grip and/or control of the tool. Exemplary surface treatments may include finger concavities for finger placement, stamped surface textures to improve grip, or soft surface textures to enhance grip. Santoprene or TPE resins may be over-molded onto the tool or attached through the use of adhesives.

In a preferred embodiment, the polycarbonate (PC) plates 500 and 600 sandwich file component 400 and bristle component 110 and may be injection molded. In this embodiment, tip component 300 may be integral and formed as part of upper plate 500. Upper plate 500 and lower plate 600 may be molded with attachment features that utilize friction or sonic welding to secure the assembled components together. In an alternative embodiment, an adhesive may be used to secure the assembled components together. In a specific embodiment shown in FIG. 8, upper plate 500 may be manufactured such that it has multiple circular protrusions 550 that are adapted to connect to multiple opposing circular indentations 650 to secure plates 500 and 600 together via a friction fit. These indentations and protrusions may be of any shape and number to secure plates 500 and 600 together. In other embodiments, the components may be welded together by a process appropriate for plastics. Bristle rings 120, 130 and 140 may include tabs 150 to align the components together and align assembled bristle component 110 into the adjoining upper and lower plates 500 and 600.

Nail file component 400 may also contain features that allow for alignment within the assembled tool. For example, nail file component 400 may have indentations 450 that are adapted to surround circular protrusions 550 and circular indentations 650.

Although the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention. For example, although center aperture 100 is described in one embodiment as being circular, it may be of any shape. Any components such as bristle rings, for example, may then be of any shape to conform to the additional aperture shapes and the like.

We claim:

1. A finger cleaning multi-tool, comprising:

a body having an upper surface, a lower surface and a circular center aperture extending through said upper and lower surfaces, wherein at least one of the upper or lower surfaces has at least three sides, a first one of the sides and a second one of the sides meet to form a tip, said center aperture is defined by an inner circumferential surface and lined with one or more first rows of bristles extending inwardly at the inner circumferential surface around its entire circumference, at least one of said first and second sides comprises a nail file component, and a third one of the sides has one or more second rows of bristles protruding therefrom.

2. The multi-tool of claim 1, wherein said bristles lining said aperture protrude a distance from said aperture to surround and scrub a finger.

3. The multi-tool of claim 1, wherein said bristles are formed from a durable and flexible plastic resin.

4. The multi-tool of claim 1, wherein said upper and lower surfaces fit together to constrain said one or more first rows of bristles.

5. The multi-tool of claim 4, wherein said upper and lower surfaces fit together to constrain said nail file component.

6. The multi-tool of claim 4, wherein said upper and lower surfaces are made from a polycarbonate resin material.

7. The multi-tool of claim 4, wherein said tip is made from a polycarbonate resin material.

8. The multi-tool of claim 4, wherein said upper and lower surfaces are made from a metallic material.

9. The multi-tool of claim 4, wherein said tip is made from a metallic material.

10. The multi-tool of claim 1, wherein the upper surface, the lower surface, or both are generally triangular.

11. The multi-tool of claim 1, wherein the one or more first rows of bristles comprises a plurality of rings sandwiched between the upper surface and the lower surface with each ring having a row of inwardly extending bristles around its entire circumference.

12. A finger cleaning multi-tool, comprising:

a body having an upper plate, a lower plate, and a circular aperture extending through the upper and lower plates;

wherein the circular aperture is defined by an inner circumferential surface and lined with one or more first rows of bristles extending inwardly from the inner circumferential surface around its entire circumference to surround and scrub the finger when inserted into the aperture, wherein at least one of the upper and lower plates has at least three sides, a first one of the sides and a second one of the sides meet to form a wedge tip for inserting under a nail of the finger when not inserted into the aperture, the wedge tip extending outwardly relative to the circular aperture, and wherein at least one of the first and second sides comprises a nail file surface facing outward from the body for filing the nail of the finger when not inserted into the aperture.

13. The multi-tool of claim 12, wherein the upper plate, the lower plate, or both are generally triangular, and the aperture is centered in the body.

14. The multi-tool of claim 12, wherein the one or more first rows of bristles comprises a plurality of stacked rings, with one of the rows of bristles extending radially inwardly from each of the rings, with each of the rings being a discrete, separate, integral piece, and with each of the rings stacked one upon another into a stack of rings sandwiched between the upper plate and the lower plate.

15. The multi-tool of claim 12, wherein the upper and lower plates fit together to constrain the nail file surface therebetween.

16. The multi-tool of claim 15, wherein the nail file surface is formed on a nail file component including indentations, wherein the upper plate, the lower plate, or both include protrusions that mate with the indentations for alignment.

17. A finger cleaning multi-tool, comprising:

a body having an upper plate, a lower plate, and a circular aperture extending through the upper and lower plates;

wherein the circular aperture is defined by an inner circumferential surface and lined with one or more first rows of bristles extending inwardly from the inner circumferential surface around its entire circumference to surround and scrub the finger when inserted into the aperture, wherein at least one of the upper and lower plates has at least three sides, a first one of the sides and a second one of the sides meet to form a wedge tip for inserting under a nail of the finger when not inserted into the aperture, the wedge tip extending outwardly relative to the circular aperture, and wherein a third one of the sides has one or more second rows of bristles extending outwardly from a generally flat surface thereof for scrubbing the nail of the finger when not inserted into the aperture.

18. The multi-tool of claim 17, wherein the upper plate, the lower plate, or both are generally triangular, and the aperture is centered in the body.

19. The multi-tool of claim 17, wherein the one or more first rows of bristles comprises a plurality of stacked rings, with one of the rows of bristles extending radially inwardly from each of the rings, with each of the rings being a discrete, separate, integral piece, and with each of the rings stacked one upon another into a stack of rings sandwiched between the upper plate and the lower plate.

20. The multi-tool of claim 19, wherein the rings each have tabs for coordinated alignment.

* * * * *

UNITED STATES PATENT AND TRADEMARK OFFICE

CERTIFICATE OF CORRECTION

PATENT NO. : 7,918,233 B2
APPLICATION NO. : 11/953369
DATED : April 5, 2011
INVENTOR(S) : Burgess et al.

It is certified that error appears in the above-identified patent and that said Letters Patent is hereby corrected as shown below:

On the Title Page:

Insert Item --(60) Related U.S. Application Data

This patent is a continuation-in-part of U.S. Design Application 29/275,610, filed December 30, 2006, issued as D559,460 on January 8, 2008.--

Signed and Sealed this
Nineteenth Day of July, 2011

David J. Kappos

David J. Kappos
*Director of the United States Patent and Trademark Office*